US006986732B2

(12) United States Patent
Zonneveld et al.

(10) Patent No.: US 6,986,732 B2
(45) Date of Patent: Jan. 17, 2006

(54) CENTRIFUGAL SEPARATION BOWL WITH MATERIAL ACCELERATOR

(75) Inventors: Edwin John William Zonneveld, Fort Langley (CA); Ishwinder Singh Grewal, Surrey (CA); Robert Neil Margarit, Delta (CA); Baha Elsayed Abulnaga, Richmond, CA (US)

(73) Assignee: Knelson Patent Inc., Langley (CA)

( * ) Notice: Subject to any disclaimer, the term of this patent is extended or adjusted under 35 U.S.C. 154(b) by 0 days.

(21) Appl. No.: 10/712,301

(22) Filed: Nov. 14, 2003

(65) Prior Publication Data

US 2004/0121892 A1 Jun. 24, 2004

Related U.S. Application Data

(60) Provisional application No. 60/430,384, filed on Dec. 3, 2002.

(51) Int. Cl.
*B04B 11/05* (2006.01)
*B04B 11/06* (2006.01)

(52) U.S. Cl. ..... 494/29; 494/67; 494/80

(58) Field of Classification Search ..... 494/1, 494/5, 11, 23, 27–30, 37, 56, 63, 80, 36, 67; 210/360.1, 380.1, 377; 209/453, 485
See application file for complete search history.

(56) References Cited

U.S. PATENT DOCUMENTS 459,197 A * 9/1891 Bodge ..... 210/365
459,858 A * 9/1891 Seymour ..... 494/47
489,101 A * 1/1893 Seymour ..... 209/199
556,567 A * 3/1896 Waring ..... 494/80
726,948 A * 5/1903 Land ..... 494/67
917,123 A * 4/1909 Peck ..... 494/29
952,653 A * 3/1910 Trent ..... 210/213
957,478 A * 5/1910 Simpson ..... 494/30
981,679 A * 1/1911 Peck ..... 494/11
1,011,078 A * 12/1911 Peck ..... 494/11
1,012,097 A * 12/1911 Peck ..... 494/1
1,283,846 A * 11/1918 Mark et al. ..... 494/60
1,322,139 A * 11/1919 Schifferle ..... 494/28
1,473,421 A * 11/1923 Eccleston ..... 494/29
1,557,672 A * 10/1925 Henry ..... 209/199
1,594,501 A * 8/1926 Eccleston ..... 494/29
1,599,502 A * 9/1926 Thomassen ..... 494/43

(Continued)

FOREIGN PATENT DOCUMENTS

AU 17487 6/1935

(Continued)

*Primary Examiner*—Charles E. Cooley
(74) *Attorney, Agent, or Firm*—Adrian D. Battison; Michael R. Williams; Ryan W. Dupuis

(57) ABSTRACT

A centrifuge bowl has a bottom accelerator for accelerating the materials from a feed duct extending into the bowl. The accelerator is a molded body having a top plate with a central hole arranged to receive the materials from the bottom feed mouth of the duct and a plurality of vanes underneath the top plate, each vane extending generally outwardly from an inner nose underneath an outer edge of the hole to an outer end at an outer edge of the top plate. The vanes each have a bottom surface lying in an imaginary bottom surface of the molded body which is conical and contains fasteners arranged to be fastened to the conical bottom wall of the bowl. A deflector plate lies underneath the hole with a bottom surface spaced from the imaginary bottom surface and intersecting the height of the vanes.

28 Claims, 4 Drawing Sheets

U.S. PATENT DOCUMENTS 1,682,099 A * 8/1928 Soyez ..... 209/270
1,684,870 A * 9/1928 Lewis ..... 209/199
1,718,547 A * 6/1929 Eccleston ..... 494/29
1,724,254 A * 8/1929 Buckbee ..... 494/62
1,733,266 A * 10/1929 Jones ..... 210/374
1,750,860 A * 3/1930 Rawlings ..... 494/2
1,853,249 A * 4/1932 Ainlay ..... 494/43
1,882,389 A * 10/1932 Vernon ..... 494/11
1,935,547 A * 11/1933 Dryhurst ..... 494/67
1,988,500 A * 1/1935 Sydney ..... 209/199
2,022,926 A * 12/1935 Schlank ..... 494/32
2,112,099 A * 3/1938 McK Ballou et al. ..... 494/67
2,132,195 A * 10/1938 Lewis ..... 494/80
2,161,476 A * 6/1939 Leja ..... 494/45
2,179,807 A * 11/1939 Asmussen ..... 494/27
2,230,013 A * 1/1941 Pecker ..... 494/58
2,272,675 A * 2/1942 Knudsen ..... 494/45
2,472,475 A * 6/1949 Hamilton ..... 209/199
2,782,925 A * 2/1957 Morton ..... 494/27
3,152,074 A * 10/1964 Fontein et al. ..... 210/781
3,256,993 A * 6/1966 Werner et al. ..... 210/370
3,366,318 A * 1/1968 Carl ..... 494/7
3,823,869 A 7/1974 Loison
3,963,175 A * 6/1976 Daubman et al. ..... 494/74
4,066,547 A * 1/1978 Hoks ..... 210/781
4,283,286 A * 8/1981 Wilkesmann ..... 210/365
4,286,748 A * 9/1981 Bailey ..... 494/29
4,361,480 A * 11/1982 Corbus et al. ..... 209/453
4,608,040 A * 8/1986 Knelson ..... 494/27
4,776,833 A * 10/1988 Knelson ..... 494/27
4,824,431 A 4/1989 McAlister
4,846,781 A * 7/1989 Knelson
4,981,219 A 1/1991 Burnell et al.
4,983,156 A * 1/1991 Knelson ..... 494/28
5,087,127 A * 2/1992 Knelson ..... 494/37
5,222,933 A * 6/1993 Knelson et al. ..... 494/29
5,230,797 A * 7/1993 Knelson ..... 210/380.1
5,281,195 A * 1/1994 Swartzbaugh ..... 494/37
5,338,284 A * 8/1994 Knelson ..... 494/28
5,354,256 A * 10/1994 Knelson ..... 494/80
5,368,541 A * 11/1994 Knelson ..... 494/37
5,372,571 A * 12/1994 Knelson et al. ..... 494/29
5,421,806 A * 6/1995 Knelson et al. ..... 494/37
5,462,513 A * 10/1995 McAlister ..... 494/56
5,586,965 A * 12/1996 Knelson ..... 494/29
5,601,523 A * 2/1997 Knelson ..... 494/29
5,601,524 A * 2/1997 Knelson ..... 494/29
5,713,826 A * 2/1998 West ..... 494/45
5,728,039 A * 3/1998 Knelson ..... 494/29
5,895,345 A * 4/1999 Knelson ..... 494/29
6,095,965 A * 8/2000 Eiderman et al. ..... 494/80
6,149,572 A * 11/2000 Knelson ..... 494/37
6,244,446 B1 * 6/2001 Schmittel ..... 209/157
6,267,250 B1 * 7/2001 Leung et al. ..... 210/369
6,616,590 B2 * 9/2003 Kessler et al. ..... 494/65
6,796,934 B1 * 9/2004 McAlister et al. ..... 494/56
2004/0121892 A1 * 6/2004 Zonneveld et al. ..... 494/67
2004/0132601 A1 * 7/2004 Peacocke et al. ..... 494/29
2005/0026766 A1 * 2/2005 Grewal ..... 494/29

FOREIGN PATENT DOCUMENTS

AU 22055 4/1936
CA 2436496 A1 * 12/2003
DE 1632324 10/1970
DE 2031350 * 12/1971
GB 2133722 8/1984
GB 2283928 A * 5/1995
WO WO 96/37307 11/1996
WO WO 99/61161 12/1999

* cited by examiner

CENTRIFUGAL SEPARATION BOWL WITH MATERIAL ACCELERATOR

This application claims priority under 35 U.S.C. 119 from U.S. Provisional Application Ser. No. 60/430,384 filed Dec. 3, 2002.

This invention relates to the centrifugal separation of heavier particulate materials from light in particulate materials in a slurry of the materials, in which the slurry is passed over the peripheral wall of a centrifuge bowl for collection of the heavier materials at the wall of the bowl and particularly relates to the provision of an accelerator at the base of the bowl onto which the materials are fed for accelerating the materials angularly to an angular velocity closer to that of the bowl.

BACKGROUND OF THE INVENTION

The Assignees of the present application manufacture a machine as shown in a number of the following patents which disclose machines of this general type and features which relate to such machines:

| | |
|---|---|
| U.S. Pat. No. 5,895,345 | Issued Apr. 20, 1999 |
| U.S. Pat. No. 5,222,933 | Issued Dec. 13, 1994 |
| U.S. Pat. No. 5,338,284 | Issued Aug. 16, 1994 |
| U.S. Pat. No. 5,586,965 | Issued Dec. 24, 1996 |
| U.S. Pat. No. 5,601,523 | Issued Feb. 11, 1997 |
| U.S. Pat. No. 5,601,524 | Issued Feb. 11, 1997 |
| U.S. Pat. No. 4,983,156 | Issued January 1991. |
| U.S. Pat. No. 4,846,781 | Issued July 1989. |
| U.S. Pat. No. 4,776,833 | Issued October 1988. |
| U.S. Pat. No. 4,608,040 | Issued Aug. 26, 1986. |

The disclosure of the above patents all filed by Benjamin Knelson is incorporated herein by reference.

In addition to the above patents of the present inventor, the following patents by other inventors show machines and features of a similar nature:

| | | |
|---|---|---|
| McAllister | U.S. Pat. No. 4,824,431 | Apr. 25, 1989 |
| McAllister | U.S. Pat. No. 5,462,513 | Dec. 31, 1995 |
| McAllister | PCT/WO 99/661161 | Dec. 2, 1999 |
| McAllister | PCT/WO 96/37307 | Nov. 28, 1996 |
| Classicon | UK 2,133,722 | Aug. 1, 1984 |
| Burnell | U.S. Pat. No. 4,981,219 | Jan. 1, 1991 |
| MacNicol | Australia 1,748,7/34 | May 8, 1934 |
| | Australia 22055/35 | Apr. 2, 1935 |
| MacIsaac | U.S. Pat. No. 1,882,389 | Oct. 11, 1932 |
| Loison | U.S. Pat. No. 3,823,869 | Jul. 16, 1974 |
| Telle | DT 1,632,324 | Oct. 29, 1970 |

The McAllister patents show a rudimentary impeller at the bottom of the bowl onto which the feed material is deposited with the intention of accelerating the feed material as it passes onto the wall of the bowl for separation. The 431 patent shows the impeller in most detail but this comprises merely a bottom plate supported on legs over a bottom drain opening of the bowl on which is mounted a plurality of radial vanes.

The MacIsaac patent discloses a bowl which is filled with pulp and rotated to extract water and includes fins on an impeller arrangement at the bottom of the bowl.

One problem which can occur in the feeding of material onto the bowl wall is that some of the material can collect into a concentrated stream as a "snake" which thus interferes with what should otherwise be a smooth layer over the bowl wall for proper separation to occur. Thus the "snake" contains unprocessed slurry which by-passes the centrifugal separation effect of the rings leading to loss of concentrate.

SUMMARY OF THE INVENTION

It is one object of the present invention to provide an improved apparatus for centrifugal separation in which there is a material accelerator and distributor at the bottom of the bowl onto which the feed material is deposited for accelerating and controlling the feed material before it moves to the bowl wall.

According to a first aspect of the invention there is provided an apparatus for separating a slurry containing intermixed particulate materials of different specific gravity comprising:

a centrifuge bowl having a bottom, a peripheral wall and an open mouth and mounted for rotation about a longitudinal axis so as to rotate the peripheral wall around the axis;

a stationary feed duct for feeding the materials to the bowl, the duct extending through the open mouth of the bowl generally along the axis to a bottom feed mouth of the duct adjacent a bottom of the bowl;

the duct and the bowl being arranged so that the material pass from the bottom of the bowl over the peripheral wall to cause a heavier portion of the materials to collect on the peripheral wall while a lighter portion of the materials in the slurry escapes over the open mouth;

and an accelerator attached at the bottom of the bowl for rotation with the bowl so as to accelerate and distribute the materials from the feed duct onto the bowl wall;

the accelerator comprising a top plate having a central hole arranged to receive the materials from the bottom feed mouth of the duct so that the materials pass through the central hole to a position underneath the plate;

a plurality of vanes underneath the top plate at angularly spaced positions around the axis of the bowl with each vane extending generally outwardly from an inner end underneath the hole to an outer end adjacent the peripheral wall;

such that the materials passing through the hole are confined underneath the top plate and are guided outwardly and accelerated angularly by the rotation of the bowl.

The fact that the materials are confined underneath the top plate ensures that their movement is controlled and guided into the channels between the vanes in controlled streams thus ensuring an accurate distribution of the materials around the rim of the accelerator and onto the bowl wall.

Preferably the accelerator includes a deflector plate underneath top plate and generally underneath the hole lying generally in a radial plane relative to the axis of the bowl and arranged to engage the materials passing through the hole so as to deflect the materials from an axial direction passing through the hole to a radial direction.

Preferably the deflector plate has a raised center lying on the axis and declines outwardly and downwardly therefrom.

Preferably the vanes each have an inner nose underneath the hole and projecting radially inwardly from an outer edge of the deflector plate with each vane extend outwardly from the nose leaving a center area of the deflector plate underneath the hole free from the vanes.

Preferably the bowl has a discharge opening in the bottom wall and wherein the deflector plate has a bottom surface spaced from a bottom wall of the bowl leaving a discharge area underneath the deflector plate.

Preferably the vanes extend to the bottom wall so that a bottom surface of at least some of the vanes sits on the bottom wall of the bowl and wherein the deflector plate is connected to and intersects the vanes at a position part way along the height thereof.

Preferably the bottom wall of the bowl includes a central discharge opening and a surface of the bottom wall substantially frusto-conical so as to be inclined downwardly and inwardly toward the discharge opening and wherein the vanes each have a bottom surface connected to the surface of the bottom wall with the bottom surface of the vanes lying in an imaginary conical surface.

Preferably the vanes each have an inner nose underneath the hole and extend outwardly from the nose leaving a center area underneath the hole free from the vanes.

Preferably the vanes each have a top surface connected to a bottom surface of the top plate.

Preferably each vane increases in dimension angularly as it increases in distance radially.

Preferably each vane is curved from the nose outwardly and in a trailing direction relative to the direction of rotation.

Preferably the accelerator including the top plate, the vanes and the deflector plate is molded or cast integrally from suitable wear resistant material which may be a resilient plastics material such as polyurethane, may be rubber or could even be a hard cast metal.

Preferably there is provided on the peripheral wall at least one annular collection recess area having a lower side wall and an upper side wall extending outwardly away from the axis to a base for collecting the heavier portion of the materials;

Preferably there is provided a plurality of fluid injection ports arranged at spaced positions around the recess for fluidizing the material in the recess.

According to a second aspect of the invention there is provided an accelerator for use in a centrifuge bowl in accelerating the materials from a feed duct extending into the bowl comprising:

a top plate with a central hole arranged to receive the materials from the bottom feed mouth of the duct so that the materials pass through the central hole to a position underneath the plate;

a plurality of vanes underneath the top plate at angularly spaced positions around the axis of the bowl with each vane extending generally outwardly from an inner end underneath the hole to an outer end at an outer edge of the top plate;

fasteners at a bottom surface arranged to be fastened to a bottom wall of the bowl with the top plate across the bottom of the bowl.

According to a third aspect of the invention there is provided an accelerator for use in a centrifuge bowl in accelerating the materials from a feed duct extending into the bowl comprising:

a top plate with a central hole arranged to receive the materials from the bottom feed mouth of the duct so that the materials pass through the central hole to a position underneath the plate;

a plurality of vanes underneath the top plate at angularly spaced positions around the axis of the bowl with each vane extending generally outwardly from an inner end underneath the hole to an outer end at an outer edge of the top plate;

a deflector plate underneath top plate and generally underneath the hole;

the vanes each having an inner nose underneath the hole and projecting radially inwardly from an outer edge of the deflector plate with each vane extending outwardly from the nose leaving a center area of the deflector plate underneath the hole free from the vanes;

wherein the vanes each have a bottom surface lying in an imaginary bottom surface of the molded body which is conical about a longitudinal central axis with fasteners arranged to be fastened to a bottom wall of the bowl;

the deflector plate having a bottom surface spaced from the imaginary bottom surface.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
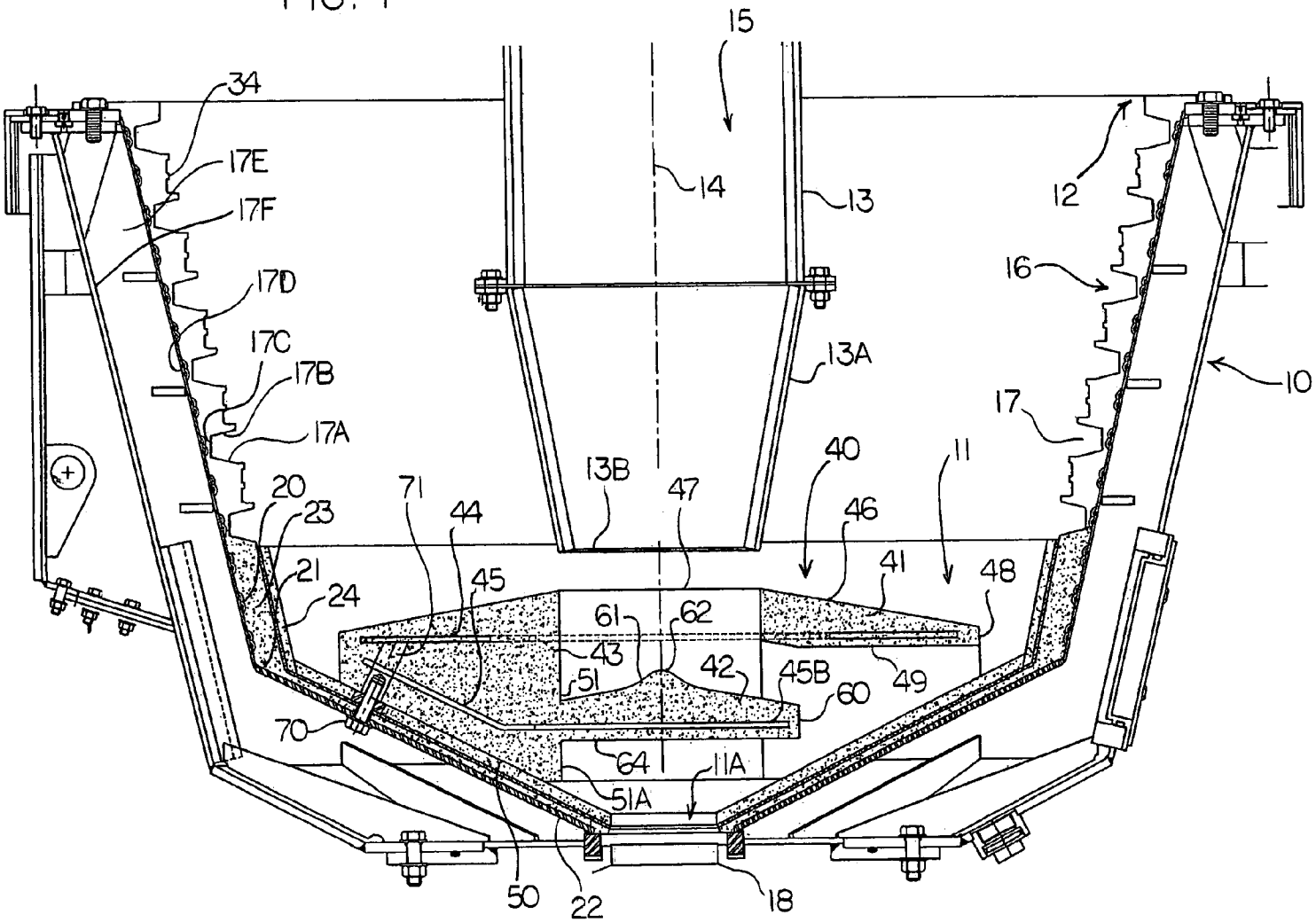
FIG. 1 is a vertical cross sectional view through a bowl of a centrifugal separation system according to the present invention and including primarily an impeller or accelerator at the base of the bowl.
Figure 3:
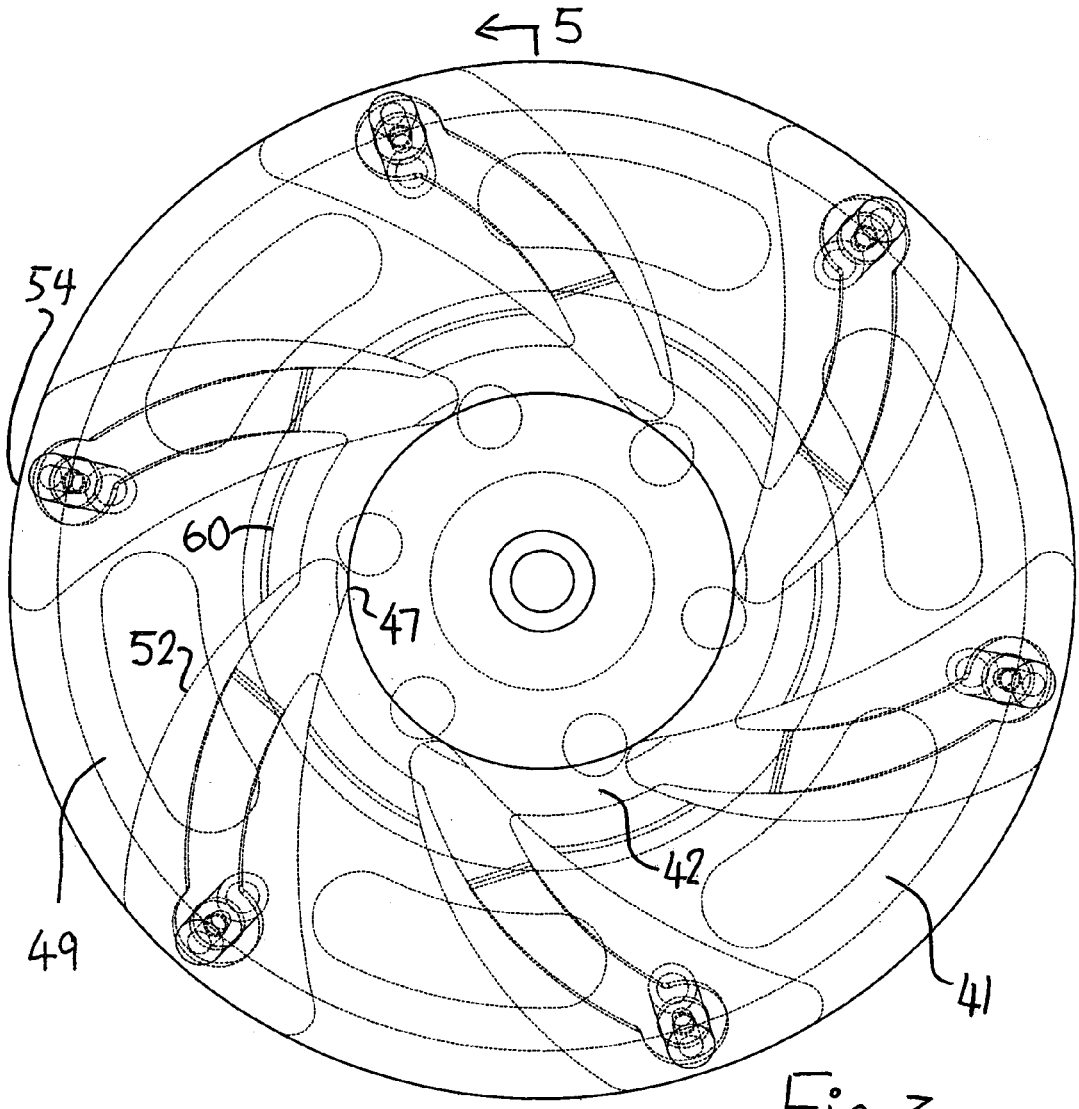
FIG. 3 is a top plan view of the impeller only of FIG. 1 on an enlarged scale.
Figure 2:
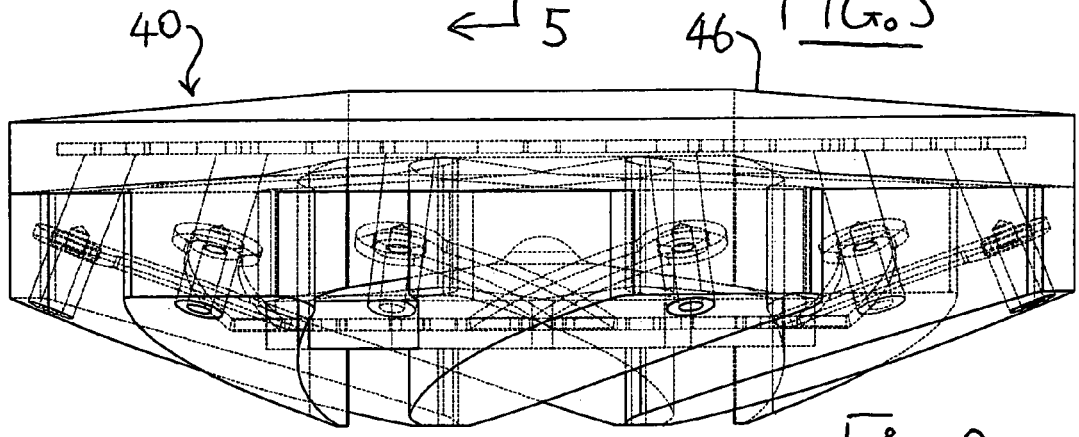
FIG. 2 is a side elevational view of the impeller only of FIG. 1 on an enlarged scale.

The centrifugal separation apparatus as shown in FIG. 1 comprises a bowl generally indicated at 10 having a base 11 and an open mouth 12. A feed duct 13 comprises a vertical pipe mounted on a central axis 14 of the bowl for feeding a slurry 15 downwardly onto the base 11 of the bowl. The bowl 10 includes a peripheral wall 16 so that the slurry moving outwardly to the peripheral wall under centrifugal forces passes over the peripheral wall for collection of heavier materials in a plurality of collection recesses 17 and for discharge of lighter materials and water over the open mouth 12.

The materials discharged from the open mouth is collected within a first launder (not shown) for collection and transportation to a discharge area. The bowl 10 is mounted on a shaft 18 for rotation about the axis 15.

U.S. Pat. No. 5,222,933 discloses further details of a conventional base of the bowl including a base plate covering a bottom central discharge opening 11A. Reference is made to Knelson U.S. Pat. Nos. 5,601,523, 5,601,524 and WO97/02894 (mentioned above) all of which disclose various constructional features of the above machine. In particular construction of the shaft is shown in U.S. Pat. No. 5,601,524. Further the general shape of the bowl including a lower frustoconical portion 16A which directs the feed material across the recesses 17 and 18 is shown in U.S. Pat. No. 5,586,965. The further patents can be referred to for further details of the construction if required.

The recesses 17 each have a recess side wall 17A which is the upper side wall and a lower side wall 17B which converge outwardly to a flat base 17C with the base being annular and lying in a cylindrical surface surrounding the axis of the bowl. Each recess has a plurality of fluid injection openings 17D for injecting fluidizing water into the recess adjacent the base of the recess so the fluidizing water can flow through the recess and mix with the materials in the recess as described in the prior patents of Knelson.

The injection openings 17D communicate with a water supply channel 17E formed in a jacket 17F as shown in prior patents mentioned herein.

In general the shaft is connected to a water supply coupling at the lower end (not shown) so that water is supplied through a hollow interior of the shaft for connection to ducts which extend outwardly to a coupling for supplying the pipes 45 and 46.

In normal operation of the bowl as shown herein, the feed material is separated so that the heavier particles collect within the recesses and the lighter particles and water escape over the mouth 12. The heavier particles are then discharged by periodic cleaning of the bowl by water washed down through the bottom discharge opening 11A. In the alternative, the bowl may be of the continuous operating type where the recesses are connected to discharge ports for periodic discharge of the materials into a surrounding launder as shown in others of the above patents.

The recesses 17 are substantially identical as shown and each is defined or separated from the next adjacent recess by a land portion 34. Thus the land portions lie on an imaginary surface of an imaginary cone which is parallel to a conical outer wall 36 of the bowl. The recesses are formed by moulding in a resilient elastomeric layer 37 formed on the conical metal outer wall 36.

The imaginary cone forms a relatively shallow angle so that each land portion is spaced outwardly from its previous land portion closer to the base 11 of the bowl.

It will be appreciated that the centrifuge bowl operates by generating a body of material within the recesses with that material begin at least partly fluidized so that the particles can migrate within the material to allow heavier particles to migrate toward the base of the deeper recess and lighter particles to migrate toward the imaginary line of the cone where the primary separation is effected between the material within the recesses and the flowing material passing in the direction of the open mouth.

The base of the bowl includes a first portion 20 which lies on the main cone angle of the bowl in the same conical plane as the land portions 34 between the recesses 17. At the bottom end 21 of the conical bowl wall is a more sharply inclined conical section 22 which converges inwardly and downwardly to the bottom opening 11A. The base portion of the bowl including the section 20 and the section 22 is primarily formed from the outer metal wall covered with a portion 23 of the liner which forms the inner bowl including the recesses, lands and bowl base. On top of this moulded liner member is applied a liner layer 24 which forms a replaceable insert accommodating a high proportion of the wear from the inflowing material.

On top of the base of the bowl is provided an accelerator 40 which takes the feed material from the duct 13 and acts to accelerate the material angularly so as to bring the material more rapidly to the speed of rotation of the bowl thus causing the material to pass more smoothly over the peripheral wall of the bowl.

The duct 13 includes a tapered section 13A at its lower end converging toward a mouth 13B close to but spaced from the accelerator 40 so that the material is fed onto a circle defined by the circular mouth 13B at the center of the accelerator.

The accelerator 40 comprises a top plate 41, a deflector plate 42 and a plurality of vanes 43. The accelerator is moulded integrally from a resilient plastics material such as polyurethane which includes metal stiffening plates 44 and 45 so as to hold the structure rigid while allowing flexibility of the surface of the material to accommodate impact and wear.

The top plate 41 has a top surface 46 with a central hole 47 substantially aligned with and co-extensive with the mouth 13B so that the material exiting the mouth 13B can enter through the hole 47 in the top plate. From the outer edge of the hole 47, the top surface 46 is inclined downwardly and outwardly to an outermost edge 48 of the top plate which is arranged adjacent to but spaced inwardly from the liner 24 on the portion 20 of the bowl.

Figure 4:
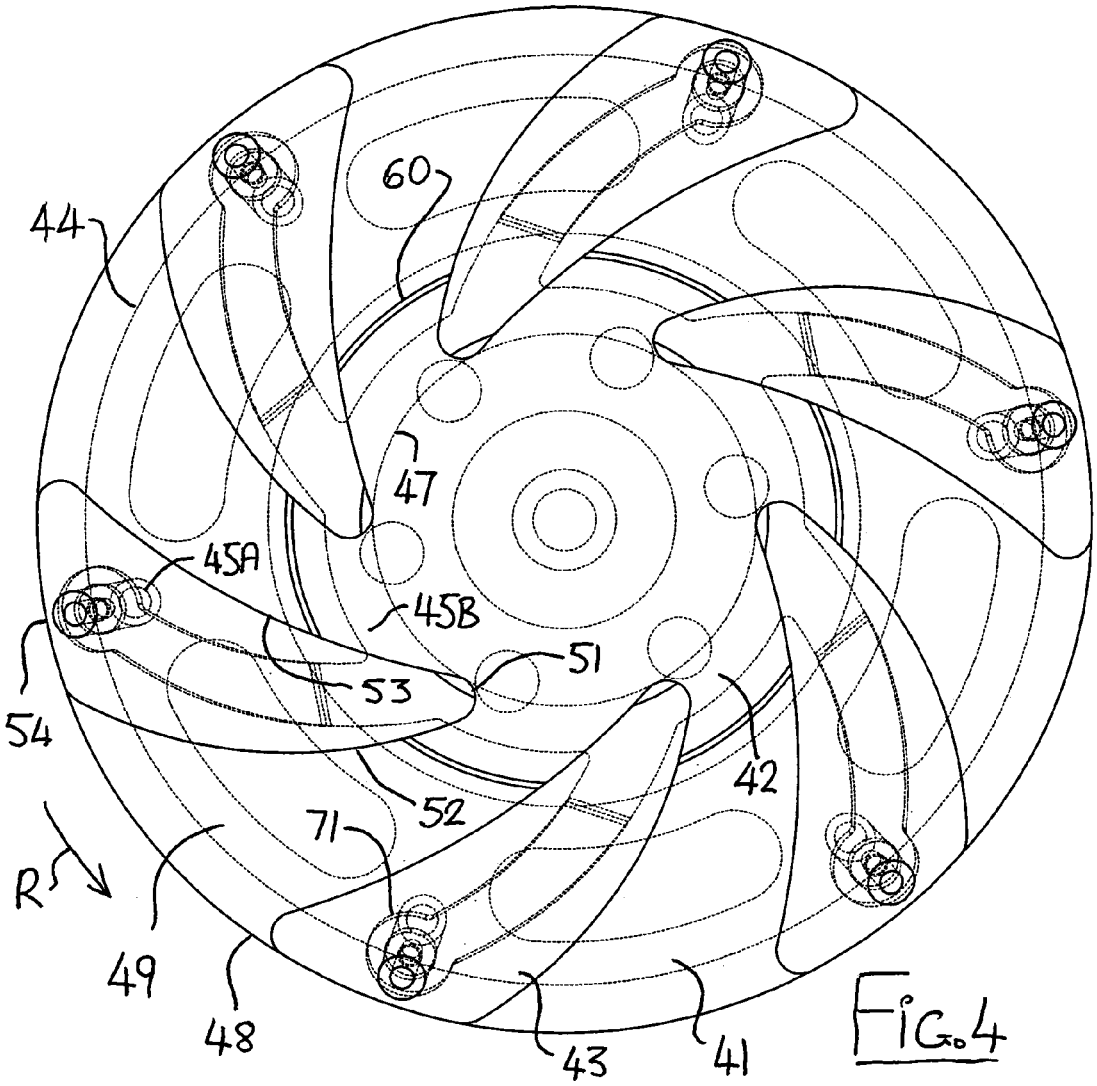
FIG. 4 is a bottom plan view of the impeller only of FIG. 1 on an enlarged scale.
Figure 5:
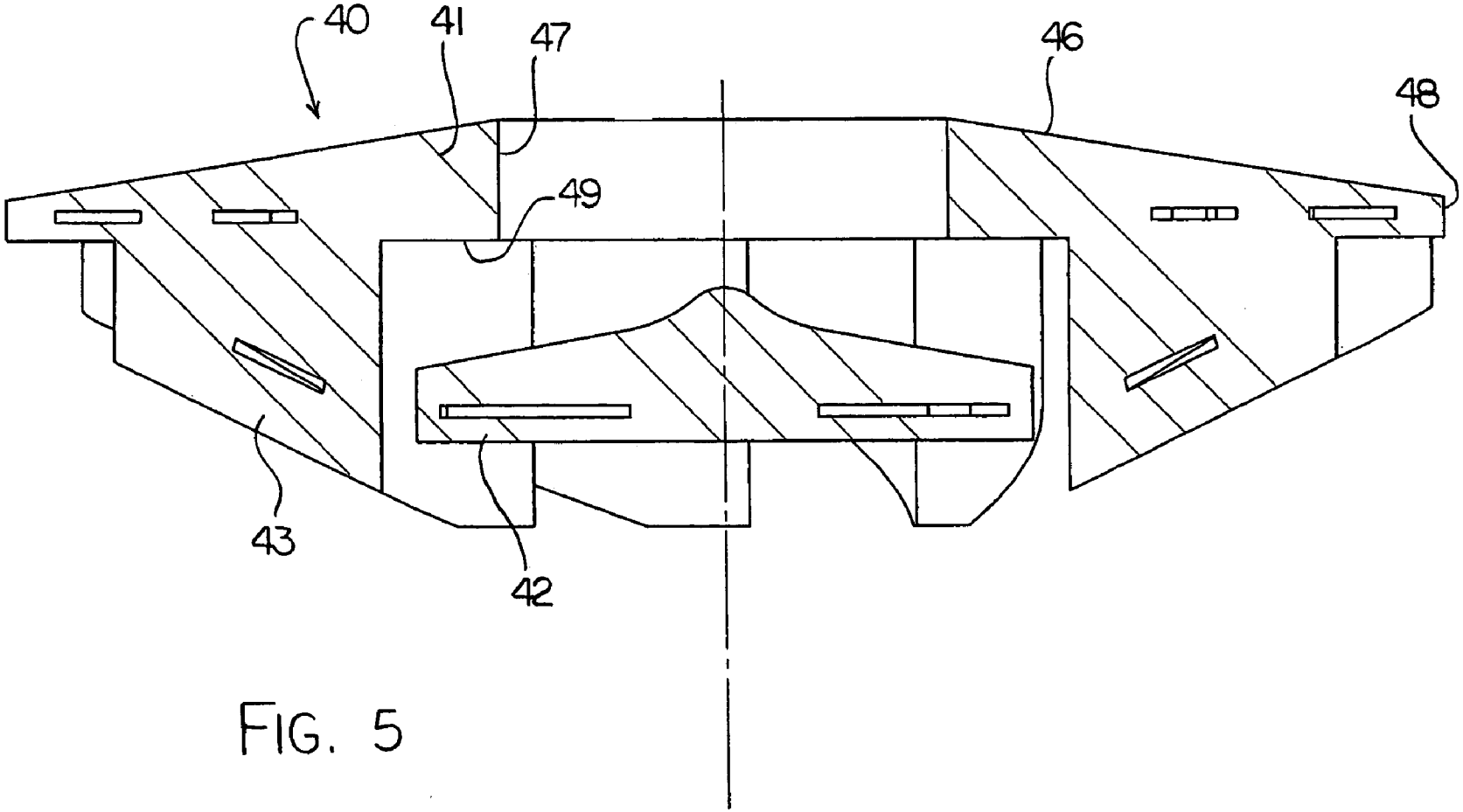
FIG. 5 is a cross sectional view of the impeller along the lines 5—5 of FIG. 3.

The top plate 41 has a bottom surface 49 spaced downwardly from the top surface. Between the bottom surface 49 of the top plate and the bottom surface 50 of the accelerator is provided a plurality of upstanding vanes. The vanes are of constant cross section taken in horizontal planes from the bottom surface of the accelerator 50 at the bottom wall of the bowl to the bottom surface of the top plate. The cross section of the vanes is best shown in FIG. 4. Thus each vane includes a nose 51 lying on the same circle as the hole 47 underneath the hole 47. Each vane includes a leading surface 52 and a trailing surface 53 which extend generally outwardly from the nose 51 toward the outer edge 48 of the top plate. Each vane includes an outer edge 54 at the outer edge 48. The vane increases in angular dimension between the leading and trailing surfaces as the vane increases in spacing from the center of the circular hole 47. Thus the vane is generally triangular in shape with the exception that the leading and trailing surfaces are curved so that the leading surface 52 is convex and the trailing surface 53 is concave. In addition each of the surfaces 52 and 53 extends outwardly and also rearwardly in a trailing direction relative to the direction of motion indicated at R. In this way rotation of the accelerator with the bowl causes the nose 51 to engage and grasp the materials fed through the hole 47 so that the materials tend to move in the direction of the arrow M over the leading surface while allowing the materials to follow the trailing curvature of the leading surface as it inclines outwardly and rearwardly thus acting to accelerate the materials in the angular direction as the materials move radially outwardly.

The curvature of the surfaces 52 and 53 together with the increase in width of the vane forms channels between the vane which are designed to cause smooth flow of the materials between the leading edge 52 of one vane and the trailing edge 53 of the next adjacent vane so that the materials in that channel are accelerated in angular velocity while moving radially outwardly to the outer edge 48 of the accelerator.

The bottom surface of the accelerator defined by the bottom surfaces of the vanes lie on a conical surface which is the same surface as the liner 24 on the bottom portion 22. Thus the bottom surface of the accelerator is an imaginary cone around the axis 14 of the bowl with a relatively shallow cone angle equal to the cone angle of the bottom portion 22 of the bowl. The bottom surface of the accelerator is defined in part by the bottom surface of the vanes and in part by an imaginary surface in between the vanes formed by the channels through which the material flows. Thus the bottom surface of the channels is formed by the liner material 24 and the bottom portion 22.

Part way down the vanes 43 is formed the deflector plate 42 which thus bridges the area between the vanes underneath the hole 47. The deflector plate has an outer edge 60 spaced outwardly from the edge of the circle 47 so that all of the material exiting the mouth 13B enters the hole 47 and impacts on the upper surface 61 of the deflector plate 42. That material is then caused to flow outwardly by its engagement with the deflector surface toward the outer edge 60 of the deflector plate whereupon the materials engage the noses 51 of the vanes 43. The upper surface 61 of the deflector plate includes a central raised projection 62 at the axis 14 from which the surface 61 declines outwardly and downwardly to the outer edge 60. Thus the material is caused on impacting the upper surface 61 with the deflector plate to change direction to slide outwardly along the declining top surface toward the noses 51.

The bottom surface 64 of the deflector plate is spaced away from the bottom surface 50 of the accelerator and from the bottom of the vanes. Thus a portion 51A of the nose of the vanes is located underneath the deflector plate and there is a space between the bottom surface 64 and the hole 11A allowing material to flow underneath the deflector plate to the hole 11A when the bowl is to be cleaned. However the presence of the nose portions 51A underneath the deflector plate ensures that any material underneath the deflector plate is also accelerated to move outwardly over the liner portion 24 on the portion 22 toward the outer edge 48 of the accelerator to enter onto the peripheral wall of the bowl.

The accelerator is fastened to the bottom wall of the bowl by machine screws 70 which engage into threaded sleeves 71 moulded into the vanes. The sleeve portion 71 are attached to the enforcing ribs 45 at an outer end 45A. The ribs 45 extend through the vanes to an inner circle 45B within the deflector plate 42. Also the sleeves 71 are engaged with the reinforcing member 44 which forms a ring lying within the top plate 41.

In this way all of the material fed through the duct 13 enters the hole 47 and thus is confined underneath the top plate without splashing or turbulence. The material thus entering the hole 47 is properly confined by the deflector plates so that it all moves outwardly into the zone of the vanes so that the vanes grasp the material and accelerate it outwardly and angularly so that the material smoothly discharges through the outer end of the channels between the vanes at the outer edge 48 of the accelerator. Thus the material is evenly distributed over the wall in an accelerated and controlled stream without any formation of uncontrolled streams which bypass the separation process. The central area of the deflector plate is free from the vanes so that the material can enter through the hole 47 onto the deflector plate without being aggressively impacted by the rotating vanes. Thus underneath the hole 47 the central area is free from any vane so that the noses lie on the same circle as the hole.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. An apparatus for separating a slurry containing intermixed particulate materials of different specific gravity comprising:

a centrifuge bowl having a bottom, a peripheral wall and an open mouth and mounted for rotation about a longitudinal axis so as to rotate the bottom and the peripheral wall around the axis;

a stationary feed duct for feeding the materials to the bowl, the duct extending through the open mouth of the bowl generally along the axis to a bottom feed mouth of the duct adjacent a bottom of the bowl;

the duct and the bowl being arranged so that the materials pass from the bottom of the bowl over the peripheral wall;

the peripheral wall having at least one annular collection recess area thereon with a lower side wall and an upper side wall extending outwardly away from the axis to a base to cause a heavier portion of the materials to collect in the at least one annular recess on the peripheral wall while a lighter portion of the materials in the slurry escapes over the open mouth;

a plurality of fluid injection ports arranged at spaced positions around the at least one annular recess for fluidizing the heavier portion of the material collecting in the at least one annular recess;

and an accelerator at the bottom of the bowl for rotation with the bowl and accelerating the materials from the feed duct;

the accelerator being attached to the bottom of the bowl for common rotation therewith;

the accelerator comprising:

a top plate having a central hole arranged to receive the materials from the bottom feed mouth of the duct so that the materials pass through the central hole to a position underneath the top plate;

and a plurality of vanes underneath the top plate at angularly spaced positions around the axis of the bowl with each vane extending generally outwardly from an inner end underneath the hole to an outer end adjacent the peripheral wall;

such that the materials passing through the hole are confined underneath the top plate and are guided outwardly and accelerated angularly by the rotation of the vanes of the accelerator with the bowl.

2. The apparatus according to claim 1 wherein the accelerator includes a deflector plate underneath top plate and generally underneath the hole lying generally in a radial plane relative to the axis of the bowl and arranged to engage the materials passing through the hole so as to deflect the materials from an axial direction passing through the hole to a radial direction.

3. The apparatus according to claim 2 wherein the deflector plate has a raised center lying on the axis and declines outwardly and downwardly therefrom.

4. The apparatus according to claim 3 wherein the vanes each have an inner nose underneath the hole and projecting radially inwardly from an outer edge of the deflector plate with each vane extend outwardly from the nose leaving a center area of the deflector plate underneath the hole free from the vanes.

5. The apparatus according to claim 1 wherein the vanes each have an inner nose underneath the hole and extend outwardly from the nose leaving a center area underneath the hole free from the vanes.

6. The apparatus according to claim 1 wherein the vanes each have a top surface connected to a bottom surface of the top plate.

7. An apparatus for separating a slurry containing intermixed particulate materials of different specific gravity comprising:

a centrifuge bowl having a bottom, a peripheral wall and an open mouth and mounted for rotation about a longitudinal axis so as to rotate the peripheral wall around the axis;

a discharge opening in the bottom of the bowl;

a stationary feed duct for feeding the materials to the bowl, the duct extending through the open mouth of the bowl generally along the axis to a bottom feed mouth of the duct adjacent a bottom of the bowl;

the duct and the bowl being arranged so that the materials pass from the bottom of the bowl over the peripheral wall to cause a heavier portion of the materials to collect on the peripheral wall while a lighter portion of the materials in the slurry escapes over the open mouth;

and an accelerator attached at the bottom of the bowl for rotation with the bowl and accelerating the materials from the feed duct;

the accelerator comprising:

a top plate having a central hole arranged to receive the materials from the bottom feed mouth of the duct so that the materials pass through the central hole to a position underneath the plate;

a plurality of vanes underneath the top plate angularly spaced positions around the axis of the bowl with each vane extending generally outwardly from an inner end underneath the hole to an outer end adjacent the peripheral wall;

and a deflector plate underneath top plate and generally underneath the hole lying generally in a radial plane relative to the axis of the bowl and arranged to engage the materials passing through the hole so as to deflect the materials from an axial direction passing through the hole to a radial direction;

such that the materials passing through the hole are confined underneath the top plate and are guided outward by the deflector plate and accelerated angularly by the vanes;

wherein the deflector plate has a bottom surface spaced from a bottom wall of the bowl leaving a discharge area underneath the deflector plate.

8. The apparatus according to claim 7 wherein the vanes extend to the bottom wall so that a bottom surface of at least some of the vanes sits on the bottom wall of the bowl and wherein the deflector plate is connected to and intersects the vanes at a position part way along the height thereof.

9. The apparatus according to claim 8 wherein the bottom wall of the bowl includes a central discharge opening and a surface of the bottom wall substantially frusto-conical so as to be inclined downwardly and inwardly toward the discharge opening and wherein the vanes each have a bottom surface connected to the surface of the bottom wall with the bottom surface of the vanes lying in an imaginary conical surface.

10. The apparatus according to claim 7 wherein the accelerator including the top plate, the vanes and the deflector plate is molded integrally from a resilient plastics material.

11. An apparatus for separating a slurry containing intermixed particulate materials of different specific gravity comprising:

a centrifuge bowl having a bottom, a peripheral wall and an open mouth and mounted for rotation about a longitudinal axis so as to rotate the peripheral wall around the axis;

a stationary feed duct for feeding the materials to the bowl, the duct extending through the open mouth of the bowl generally along the axis to a bottom feed mouth of the duct adjacent a bottom of the bowl;

the duct and the bowl being arranged so that the materials pass from the bottom of the bowl over the peripheral wall to cause a heavier portion of the materials to collect on the peripheral wall while a lighter portion of the materials in the slurry escapes over the open mouth;

and an accelerator attached at the bottom of the bowl for rotation with the bowl and accelerating the materials from the feed duct;

the accelerator comprising:

a top plate having a central hole arranged to receive the materials from the bottom feed mouth of the duct so that the materials pass through the central hole to a position underneath the plate;

and a plurality of vanes underneath the top plate at an angularly spaced positions around the axis of the bowl with each vane extending generally outwardly from an inner end underneath the hole to an outer end adjacent the peripheral wall;

such that the materials passing through the hole are confined underneath the top plate and are guided outwardly and accelerated angularly by the rotation of the bowl;

wherein each vane increases in dimension angularly as it increases in distance radially.

12. The apparatus according to claim 11 wherein the accelerator including the top plate and the vanes is molded integrally from a resilient plastics material.

13. An apparatus for separating a slurry containing intermixed particulate materials of different specific gravity comprising:

a centrifuge bowl having a bottom, a peripheral wall and an open mouth and mounted for rotation about a longitudinal axis so as to rotate the peripheral wall around the axis;

a stationary feed duct for feeding the materials to the bowl, the duct extending through the open mouth of the bowl generally along the axis to a bottom feed mouth of the duct adjacent a bottom of the bowl;

the duct and the bowl being arranged so that the materials pass from the bottom of bowl over the peripheral wall to cause a heavier portion of the materials to collect on the peripheral wall while a lighter portion of the materials in the slurry escapes over the open mouth;

and an accelerator attached at the bottom of the bowl for rotation with the bowl and accelerating the materials from the feed duct;

the accelerator comprising:

a top plate having a central hole arranged to receive the materials from the bottom feed mouth of the duct so that the materials pass through the central hole to a position underneath the plate;

and a plurality of vanes underneath the top plate at angularly spaced positions around the axis of the bowl with each vane extending generally outwardly from an inner end underneath the hole to an outer end adjacent the peripheral wall;

such that the materials passing through the hole are confined underneath the top plate and are guided outwardly and accelerated angularly by the rotation of the bowl;

wherein each vane is curved from the nose outwardly and in a trailing direction relative to the direction of rotation.

14. The apparatus according to claim 13 wherein the accelerator including the top plate and the vanes is molded integrally from a resilient plastics material.

15. An accelerator for use in a centrifuge bowl rotatable about an axis in accelerating the materials from a feed duct extending axially into the bowl, the accelerator comprising:

a molded body;

the molded body having a top plate with a central hole around the axis arranged to receive the materials from the bottom feed mouth of the duct so that the materials pass through the central hole to a position underneath the plate;

the molded body having a plurality of vanes underneath the top plate at angularly spaced positions around the axis with each vane extending generally outwardly from an inner end underneath the hole to an outer end at an outer edge of the top plate;

the molded body having fasteners at a bottom surface arranged to be fastened to a bottom wall of the bowl with the top plate across the bottom of the bowl;

wherein the molded body includes a deflector plate underneath top plate and generally underneath the hole;

and wherein the deflector plate has a bottom surface spaced from the bottom surface of the molded body leaving a discharge area underneath the deflector plate.

16. The accelerator according to claim 15 wherein the deflector plate has a raised center and declines outwardly and downwardly therefrom.

17. The accelerator according to claim 15 wherein the vanes each have an inner nose underneath the hole and projecting radially inwardly from an outer edge of the deflector plate with each vane extend outwardly from the nose leaving a center area of the deflector plate underneath the hole free from the vanes.

18. The accelerator according to claim 15 wherein the vanes extend to the bottom surface and wherein the deflector plate is connected to and intersects the vanes at a position part way along the height thereof.

19. The accelerator according to claim 18 wherein the vanes each have a bottom surface lying in an imaginary surface which is conical about the axis.

20. The accelerator according to claim 15 wherein the vanes each have an inner nose underneath the hole and extend outwardly from the nose leaving a center area underneath the hole free from the vanes.

21. The accelerator according to claim 15 wherein the vanes each have a top surface connected to a bottom surface of the top plate.

22. An accelerator for use in a centrifuge bowl rotatable about an axis in accelerating the materials from a feed duct extending axially into the bowl, the accelerator comprising:

a molded body;

the molded body having a top plate with a central hole around the axis arranged to receive the materials from a bottom feed mouth of the duct so that the materials pass through the central hole to a position underneath the plate;

the molded body having a plurality of vanes underneath the top plate at angularly spaced positions around the axis with each vane extending generally outwardly from an inner end underneath the hole to an outer end at an outer edge of the top plate;

the molded body having fasteners at a bottom surface arranged to be fastened to a bottom wall of the bowl with the top plate across the bottom of the bowl;

wherein each vane increases in dimension angularly as it increases in distance radially.

23. An accelerator for use in a centrifuge bowl rotatable about an axis in accelerating the materials from a feed duct extending axially into the bowl, the accelerator comprising:

a molded body;

the molded body having a top plate with a central hole around the axis arranged to receive the materials from a bottom feed mouth of the duct so that the materials pass through the central hole to a position underneath the plate;

the molded body having a plurality of vanes underneath the top plate at angularly spaced positions around the axis with each vane extending generally outwardly from an inner end underneath the hole to an outer end at an outer edge of the top plate;

the molded body having fasteners at a bottom surface arranged to be fastened to a bottom wall of the bowl with the top plate across the bottom of the bowl;

wherein each vane is curved from the inner end outwardly and in a trailing direction relative to the direction of rotation.

24. An accelerator for use in a centrifuge bowl rotatable about an axis in accelerating the materials from a feed duct extending axially into the bowl, the accelerator comprising:

a molded body;

the molded body having a top plate with a central hole around the axis arranged to receive the materials from the bottom feed mouth of the duct so that the materials pass through the central hole to a position underneath the plate;

the molded body having a plurality of vanes underneath the top plate at angularly spaced positions around the axis with each vane extending generally outwardly from an inner end underneath the hole to an outer end at an outer edge of the top plate;

the molded body having a deflector plate underneath top plate and generally underneath the hole;

the vanes each having an inner nose underneath the hole and projecting radially inwardly from an outer edge of the deflector plate with each vane extending outwardly from the nose leaving a center area of the deflector plate underneath the hole free from the vanes;

wherein the vanes each have a bottom surface lying in an imaginary bottom surface of the molded body which is conical about the axis with fasteners arranged to be fastened to a bottom wall of the bowl;

the deflector plate having a bottom surface spaced from the imaginary bottom surface.

25. The accelerator according to claim 24 wherein the vanes each have a top surface connected to a bottom surface of the top plate.

26. The accelerator according to claim 24 wherein each vane increases in dimension angularly as it increases in distance radially.

27. The accelerator according to claim 24 wherein each vane is curved from tile nose outwardly and in a trailing direction relative to the direction of rotation.

28. The accelerator according to claim 24 wherein the deflector plate has a raised center and declines outwardly and downwardly therefrom.

* * * * *